US007950329B1

(12) United States Patent
Nemtyshkin et al.

(10) Patent No.: US 7,950,329 B1
(45) Date of Patent: May 31, 2011

(54) CARTRIDGE FOR REMOTE ELECTROSHOCK WEAPON

(76) Inventors: Oleg Nemtyshkin, Toliatty (RU); Yury Ladyagin, Moscow (RU)

( * ) Notice: Subject to any disclaimer, the term of this patent is extended or adjusted under 35 U.S.C. 154(b) by 345 days.

(21) Appl. No.: 11/560,879

(22) Filed: Nov. 17, 2006

(51) Int. Cl.
*F42B 5/02* (2006.01)

(52) U.S. Cl. ..... 102/430; 102/502; 102/504; 102/439; 42/1.08; 361/232

(58) Field of Classification Search ..... 102/502, 102/504, 430, 439; 42/1.08, 1.11; 361/232
See application file for complete search history.

(56) References Cited

U.S. PATENT DOCUMENTS

| | | | | |
|---|---|---|---|---|
| 8,843 | A | 3/1852 | Sonnenburg et al. | |
| 3,803,463 | A | 4/1974 | Cover | |
| 5,654,867 | A | 8/1997 | Murray | |
| 5,747,719 | A * | 5/1998 | Bottesch | 89/1.1 |
| 5,786,546 | A * | 7/1998 | Simson | 102/438 |
| 6,461,357 | B1 * | 10/2002 | Sharkey et al. | 606/45 |
| 6,575,073 | B2 * | 6/2003 | McNulty et al. | 89/1.11 |
| 7,314,007 | B2 * | 1/2008 | Su | 102/502 |
| 7,434,517 | B1 * | 10/2008 | Linker | 102/502 |
| 2005/0109200 | A1 * | 5/2005 | McNulty | 89/1.11 |
| 2006/0225334 | A1 * | 10/2006 | Kapeles et al. | 42/1.08 |
| 2006/0292528 | A1 * | 12/2006 | Keely et al. | 434/11 |
| 2007/0188972 | A1 * | 8/2007 | Nerheim et al. | 361/262 |

* cited by examiner

*Primary Examiner* — J. Woodrow Eldred
*Assistant Examiner* — Gabriel J Klein
(74) *Attorney, Agent, or Firm* — Ishman Law Firm P.C.

(57) ABSTRACT

A cartridge for launching from an electroshock weapon includes a housing adapted for operative connection with the electroshock weapon and having a chamber functioning as a barrel for a projectile unit. The projectile unit includes a conductive head member and an orderly packed wire assembly of electric wire connected with said head member and preferably in coil form. The head member includes a barbed needle for establishing an electrical connection with a target. The electric wire is connected at one end to the head member and at the other end to the housing whereby the wire is withdrawn from the coil as the projectile unit advances toward said target. The project unit is launched by a percussive cap at a rear end of said chamber ignited by the electroshock weapon. At the target an electrical connection is established through the wire to the weapon.

10 Claims, 4 Drawing Sheets

CARTRIDGE FOR REMOTE ELECTROSHOCK WEAPON

FIELD OF THE INVENTION

The invention relates to devices for launching electric wire for remotely impacting various targets with electric current, and more particularly to a unitary cartridge for launching electric wire from a weapon for remote impact on various targets and thereafter delivering an electric current transmitted along the electric wire for use with a remote electroshock weapon.

BACKGROUND OF THE INVENTION

Devices for launching weapons attached to a wire for conducting electricity to the impart target are well know. An early version is the "Electric Whaling Apparatus" as disclosed in U.S. Pat. No. 8,843 wherein a harpoon is electrically connected to an electric cable which, when the harpoon is thrown, unwinds from a coil stowed next to the harpoon thrower or cannon. The deficiencies of the device are its substantial girth, which makes it impossible to apply this device to launching electric wire from a handheld remote weapon to strike various targets, particularly in modern handheld remote electroshock devices such as the "Air Taser" made by Stinger Systems.

Also known is a device as disclosed in U.S. Pat. No. 5,654,867 that contains double cartridges for launching electric wire to impact various remote targets. Therein, the cartridge contains a common housing, within which are two barrels with the launched projectiles, which represent oblong cylindrical shafts that are fitted at the ends with barbed needles, similar to those used in fishing. The projectiles are ejected from the barrels using a pyrotechnic charge triggered upon firing by the high voltage applied in the DEShO to hit the target. In the cartridge's special pockets are two sets of electric wire that are drawn out of the housing by the projectiles upon firing. When the projectiles hit the target, they attach to it with the barbed needles, and the high-voltage shock is transmitted to the target along the two wires extending from the cartridge.

Also known is the "Weapon for Immobilization and Capture" as disclosed in U.S. Pat. No. 3,803,463 issued Apr. 9, 1974 which discloses, as one embodiment of this device, a device with a double wire-launching cartridge for hitting remote targets. One variant of the double cartridge contains a common housing, within which are four barrels with obturators (wads) and launch projectiles, comprising multi-spike balls connected to an electric wire situated packed on mandrels that are tapered to facilitate unwinding when the device is fired. A propellant pyrotechnic charge is ignited by an electrical current and, upon ignition, simultaneously launches the spherical projectiles, which are accelerated within the four barrels by the obturators (wads). At this, the spherical projectiles fly out of the cartridge barrels, pulling out the electric wires that are wound around the tapered mandrels and unwinding them from those mandrels. In the flight process, the electric wires are unwound from the tapered mandrels until the spherical projectiles hit and attach to the target with their multi-spike "burr-like" head portion.

Currently, rather than the multi-spike "burr-like" projectiles, all types of remote electroshock weapon cartridges use oblong projectiles with a needle that is the most effective in meeting the criterion of target-gripping along with maximum ease of manufacture. In essence, the cartridge type described above comprises a dual unitary cartridge containing a common housing and a launch power source, a propellant or pyrotechnic charge, a means of triggering the energy source such as an electrical igniter, two or more barrels, two or more projectiles for drawing the electric wire out of the cartridge housing and attaching the electric wire to the target, and two or more compact sites for locating the orderly packed electric wire so it is correctly delivered to the target upon firing, with no chance of it becoming tangled or severed while being unwound at a speed of no less than 30 m/second). However, compared to the unitary cartridge for a firearm, which combines the primer (percussive cap), the energy source for launching the projectile (powder), and the projectile itself (e.g., a bullet) within a single housing (the casing), the cartridge in the design described here differs substantially. The housing of the cartridge type described here also contains (combines) both the primer, the pyrotechnical energy source, and the projectile(s), as well as the electrical wire assembly necessary for this type of cartridge, but they are situated separately from one another, thus occupying substantially more space than that of the unitary firearm cartridge, in which all the necessary firing components are placed in a common cartridge chamber (the casing). The separate placement of the necessary firing components, besides increasing the cartridge's volume (i.e., its external dimensions), automatically increases the cartridge's overall weight as well, since the divided placement of the firing elements necessitates increasing the amount of material used to manufacture the housing, with separate sites in which to place the firing components, which means also increasing the weight of the housing material.

The need to combine at least two projectiles and at least two mutually isolated sets of electric wire within the housing of a single cartridge is dictated by the impossibility of effectively transmitting electrical energy to a target other than by a two-line mode of transmitting electrical energy, using two wires that are mutually isolated by an air gap or insulation. In the cartridge type described here, one can also use two pyrotechnical energy sources to launch the two projectiles, operating in separate barrels. This does not change the design principle. A common pyrotechnical energy source is used merely to decrease the dimensions and price of the product.

The need to have an air gap of at least 30 to 40 mm. between the barrels of the double cartridge, to prevent electrical disruption through the air between the two electric wires during firing, increases the cartridge's dimensions and the weight of the housing material still more. A comparison of the relative energy performance of a firearm cartridge (for the sake of consistency, using the least possible muzzle energy) and the type of cartridge described here, by volume or by weight ($J/cm^3$; j/g), shows that a firearm cartridge with minimum muzzle energy, such as a "Short target" 5.6 mm. rimfire cartridge, has a relative performance of about 75 $J/cm^3$ or 14 J/g per firing. The best cartridge models with a pyrotechnical energy source for the type of launch described here have a relative performance of no more than 0.4 $J/cm^3$ or 0.26 J/g per twin firing. This takes into account the fact that both a firearm cartridge, designed not for reaching targets with a kinetic effect but only to penetrate a paper target, and the DEShO cartridges perform the same task above all else—that is, to deliver the projectile to its target. Even with the projectile's negligible muzzle energy per shot from one cartridge barrel (no more than 4 J), or 8 J for a twin firing, the relative energy performance that the type of cartridges described here need to pull the electric wire from the cartridge unit and fly to the target at a speed of about 30 to 40 m/sec, defers by an order of magnitude to the energy performance of unitary cartridges for firearms designed for marking openings in a paper target.

In order to accelerate the projectile that is being launched to the target and drawing the electric wire out of the housing in which it is stowed, a barrel is used, consisting of a cylindrical chamber in which the obturator element (wad) that pushes the projectile is accelerated. Although in this case the "barrel" assembly comprises a part of the weapon, not the cartridge, the cartridge barrels, which are situated in a housing shared by the projectile and the charge, can be described as being like the elongated case necks of contemporary domestically manufactured cartridges such as the SP-4 "Val" or the 18×45 and 18×70 cartridges for self-defense devices such as the PB-4 "Osa". Such cartridges, which, being proper cartridges, simultaneously fulfill the function of barrel in a weapon for which barrels in their pure form (i.e., mounted on the weapon itself) are for whatever reasons not desirable. In a remote electroshock weapon, a barrel is in fact undesirable due to the insignificant muzzle energy required, the modest requirements as to fire dispersion, and the high demands as to the weapon's compactness due to the placement within it—besides the launching apparatus—of an electrical device producing electrical impulses that hit the target. Thus the concept of "cartridge of a remote electroshock weapon" falls under the concept of the "dual cartridge" or "dual cartridge containing barrel within it", in which the individual firing elements such as the "primer", "propellant charge", "projectile", and the key supplemental element needed for the projectile in a remote electroshock weapon—the "packed electric wire"—are all located within the same housing, but the assembly is extremely inefficient compared to the unitary cartridge of a firearm (including a cartridge with an elongated casing comprising the barrel as well), where all the necessary firing components are located within a single housing.

Compared to the unitary cartridge of a firearm, which integrates the primer (the percussive cap), the energy source for launching the projectile (powder), and the projectile itself (e.g., a bullet) within a single housing (the casing), the cartridge in the design described here has a substantial difference. The housing of the cartridge type described here also contains (combines) both the energy source for launching (a pyrotechnical or propellant charge), and the projectile(s), as well as the electrical wire assembly necessary for this type of cartridge, but they are situated separately from one another, thus occupying substantially more space than that of the unitary firearm cartridge, in which all the necessary firing components are placed in a common cartridge chamber (the casing). The separate placement of the necessary firing components, besides increasing the cartridge's volume (i.e., its external dimensions), automatically increases the cartridge's overall weight as well, since the divided placement of the firing elements necessitates an increase the amount of material used to manufacture the housing, with separate sites for situating the firing components, which means increasing the weight of the housing material as well.

The disadvantages of this design are as follows:

1. The placement of the electric wire on tapered mandrels in special compartments (chambers) of the cartridge, divided from the barrels, due to which it is impossible to minimize the cartridge dimensions beyond a certain magnitude determined by the length of the unwound wire, the dimensions of the mandrels and the chambers in which they are located, and the distances needed to prevent a disruptive discharge [through] the air gaps between the lead-in electrodes.

2. The se parate placement of the projectile, a component of the electric wire essential to firing, the launch-producing pyrotechnic charge and the conventional-type barrel precludes any reduction in the overall dimensions of the firing system.

3. The impossibility of creating a multi-firing weapon (over two shots in a single DEShO) of the type described here, that could be held in one hand (like a pistol or revolver) using dual cartridges, due to their large dimensions.

SUMMARY OF THE INVENTION

The present invention is aimed at solving the challenge of creating a miniaturized unitary cartridge for launching electric wire for use in a handheld remote electroshock weapon, in which it is the minimum proportions of the cartridge that determine the overall size and weight parameters. Minimization of the cartridge's size and weight parameters is achieved by combining an orderly packed electric wire, a launched projectile, and a pyrotechnic energy source for launching the projectile along with its triggering device in a common housing chamber (casing), and by eliminating the barrel used to accelerate the launched projectile.

In a variant of the proposed invention, firing noise and the release of combustion products from the pyrotechnic launching compound into the atmosphere are eliminated by combining the projectile and its launching device with a device to isolate the propulsion (pyrotechnic) gases within a single cartridge chamber.

Eliminating the housing with twin firing and moving to a system of individual firing from a single housing makes it possible to create a remote electroshock weapon similar to a multiple-charge manual or automatic firearm. In such a remote electroshock weapon, as opposed to an ordinary firearm, two magazines or detachable clips are situated with the proposed unitary cartridges, while the weapon's design precludes an internal short-circuit or internal high-voltage airborne disruption between the electric wires when fired toward the target. The magazines or clips of the remote electroshock weapon are fitted with the proposed electric wire-launching unitary cartridges, and the necessary dual firing to deliver the two wires to the target is accomplished by simultaneously triggering the two cartridges of the proposed type, located within the electroshock weapon's magazine or clip.

1. In one aspect the cartridge for launching electric wire comprises a housing, barrel, an orderly packed electric wire, a projectile for drawing the wire out of the cartridge housing and attaching to the target, a pyrotechnical power source. The cartridge is distinguished by the fact that the cartridge housing has a common internal chamber comprising a barrel, within which is placed a pyrotechnic charge with an electric or mechanical trigger, and electric wire arranged in the form of a compact single-layer, multi-layer or hybrid self-supported coil, which comprises a projectile, one end of the electric wire of which is rigidly or flexibly secured in the cartridge housing while the other end has a device for attaching to the target.

2. In another aspect, the cartridge housing is made of metal or plastic.

3. In another aspect, the cartridge electric wire assembly comprises a projectile having a target-gripping device in the form of a conductive head having one or several barbed needles or an adhesive component.

4. In another aspect, the cartridge electric wire assembly for the projectile is cemented by a ductile or brittle-ductile bonding agent.

5. In another aspect, the electric wire assembly for the projectile has a cylindrical propulsion shell in the form of an oblong barrel section with an open and a closed end, fashioned out of metal or plastic, while the device for securing the projectile's propulsion shell on the target comprises one or several barbed needles or a self-adhering component.

6. In another aspect, one end of the electric wire of the projectile unit has an electrical connection to the target attachment device, while the other end of the wire is connected to a non-conductive line, which in turn is connected, rigidly or movably, to the cartridge housing inside the housing chamber.

7. In another aspect the non-conductive line is made of heat-resistant or fire-resistant material and placed above the pyrotechnic charge or around its housing, and is secured in the closed end of the cartridge chamber.

8. In another aspect, the front of the cartridge chamber has a reduced diameter and the pyrotechnic charge is separated from the projectile by an obturator wad, while the end of the electric wire assembly or non-conductive line is secured on the obturator wad.

9. In another aspect, the cartridge chamber is tapered, with the front diameter smaller than the rear.

10. In another aspect, at the place where the transition begins from the cartridge chamber with the plastic housing to the front portion with reduced diameter, there is a conducting lead terminal from the chamber to the external surface of the housing.

11. In another aspect, the obturator wad includes a pyrotechnic charge.

12. In another aspect, the obturator wad is made of two parts, an obturating part and a thrust-bearing part, and the end of the electric wire of the projectile unit or the end of the non-conductive line is attached to the metallic portion of the obturator.

13. In another aspect the obturator wad consists of one part in which, with or without an electric outlet, one end of the electric wire for stowing the projectile or the non-conductive line is attached to the pyrotechnic charge.

14. In another aspect, the pyrotechnic charge is triggered by an electrical spark, a fusehead, or percussively.

15. In another aspect, the pyrotechnic charge produces non-conductive products of combustion.

16. In another aspect, the projectile is secured by a split sleeve or elastic insert, and/or an adhesive film.

17. In another aspect, the adhesive film is metal-coated or made with a metal adhesive.

18. In another aspect, the electric wire is made insulated or non-insulated.

BRIEF DESCRIPTION OF THE DRAWINGS

The above and other features and advantages of the invention will become apparent upon reading the following written description taken in conjunction with the accompanying drawings in which.

DESCRIPTION OF THE PREFERRED EMBODIMENTS

Depending on the type of electroshock weapon used and the technological capabilities, different variations of the cartridge may be applied.

Figure 1:
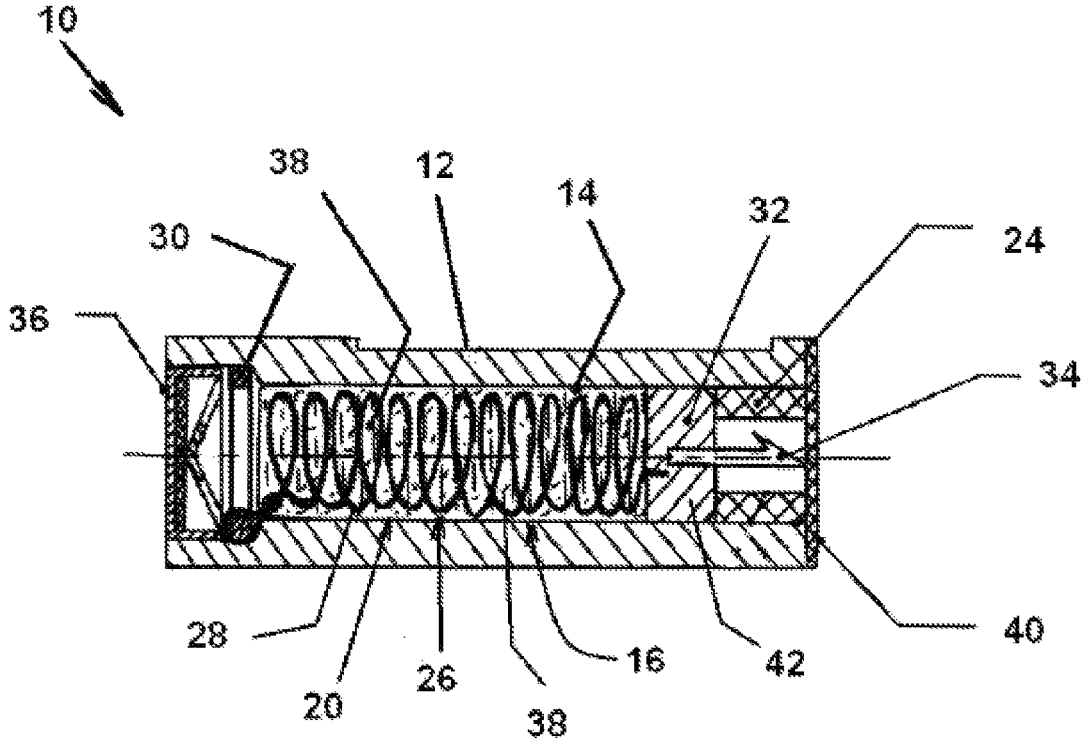
FIG. 1 is a cross sectional view of a cartridge for an electroshock weapon in accordance with an embodiment of the invention.

Referring to FIG. 1, a cartridge 10 for use with a suitable electroshock weapon, not shown, includes a metal casing or housing 12, of rectangular or circular cross section, having an axial chamber 14 carrying a projectile unit 16. The chamber of the housing 12 also forms the barrel, for launching or firing the projectile unit 16.

The projectile unit 16 comprises an electric wire assembly 20, a head assembly 22. A split sleeve assembly 24 is located in the chamber 14 in front of the projectile unit 16. The electric wire assembly 20 includes a coil 26 of electrical wire 28 connected, by soldering or beading, at one end to the head assembly 22 and at the other end to an annular ring or washer 30. The coil 26 is in the form of a compact single-layer, multi-layer or hybrid self-supported wire.

The head assembly 22 includes a cylindrical head 32 carrying a frontally projecting barbed needle 34 on the outer end face for self adhering attachment at the target. Other suitable attaching means include a plurality of barbed or non-barbed pointed members, conductive adhesives or other like devices having the ability to attach sufficiently at the target for delivering an electrical charge. The head 32 is preferably formed of a heavy metal such as copper, lead, or an alloy thereof. A percussive cap 36 is pressed into or threaded onto the closed end of the chamber 14 of the cartridge 10. The wire assembly 20 is cemented with a bonding agent 38, for instance paraffin or ceresin wax. The projectile unit 16 including the sleeve assembly 24 is secured within the chamber by an adhesive film 40, which prevents the projectile unit 16 from moving or falling out of the housing 12 should the cartridge 10 fall to the ground or be knocked about during transport. The sleeve assembly 24 is annular and diametrically halved into semicircular segments 42 surrounding the needle 34.

Figure 2:
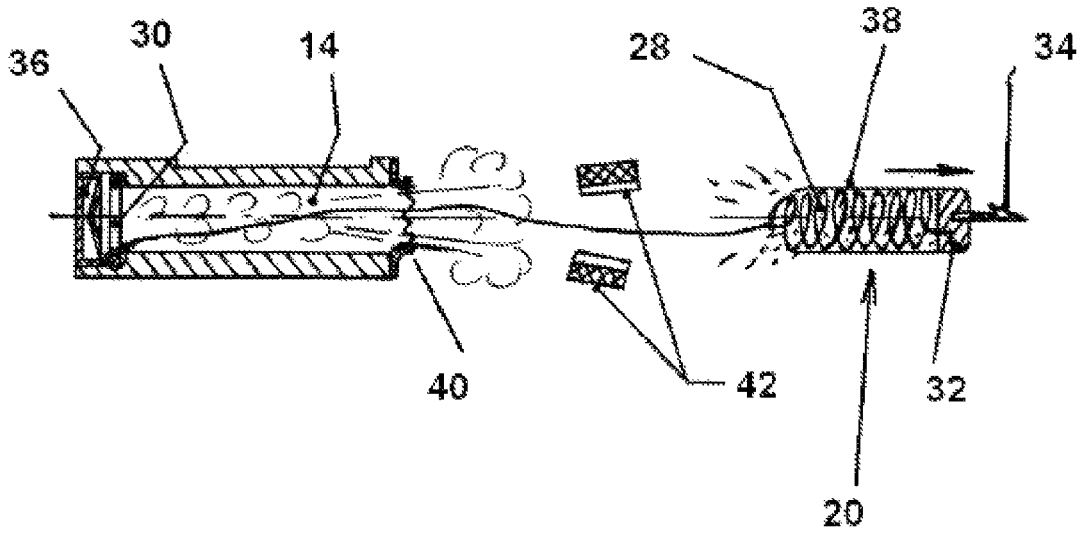
FIG. 2 is a cross sectional view of the cartridge of FIG. 1 at the moment of firing.

FIG. 2 illustrates the cartridge 10 at the moment of firing. The hammer of the electroshock weapon perforates the percussive cap 36, which triggers the pyrotechnic charge, which is at the same time a propulsive charge. Pressure exerted by the combustion gases from the pyrotechnic charge accelerate the projectile unit 16 in the chamber 14, simultaneously ejecting the split sleeve assembly 24 and rupturing the adhesive film 40 with the head 32 and the needle 34, and the projectile unit 16 begins moving toward the target. With the movement of projectile unit 16 along with head 24, the end of the wire 26, held back by washer, remains in cartridge chamber 14. The bulk of the wire assembly, cemented by bonding agent 38 along with head 24, executes its flight toward the target, during which the sleeve segments 42 separate as illustrated. The short duration of the hot combustion gases' effect on the electric wire of projectile unit 16 allows for the wire to be made either uninsulated or with insulation. As projectile unit 16 flies, the electric wire assembly is drawn out of the projectile's compact body, breaking bonding agent 38. Upon hitting the target, the head 24, along with the remainder of the unit's compact body, attaches to the target with the barbed needle 34. The weapon's high-voltage potential is delivered to the target by means of advancing it to the cartridge housing 12 and from there through the electric wire 28.

Figure 3:
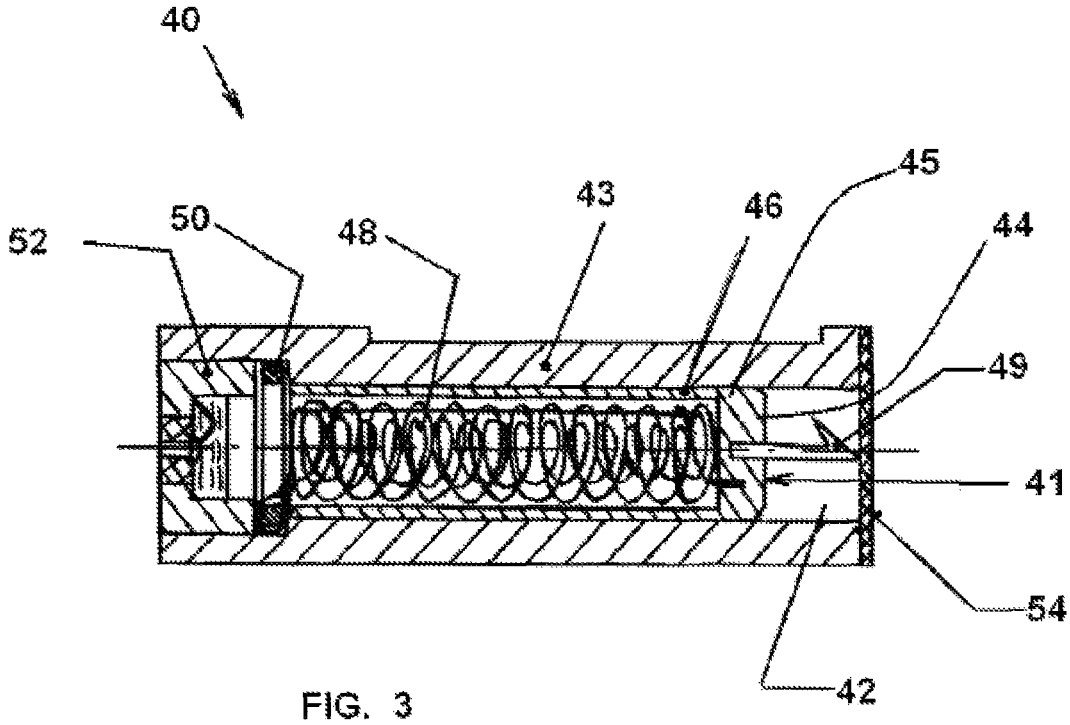
FIG. 3 is a cross sectional view of a cartridge in accordance with another embodiment of the invention.

Another embodiment is shown in FIG. 3 wherein the cartridge 40 includes a projectile unit 41 carried in the chamber 42 of a housing 43. The projectile unit 41 includes a head assembly 44 having a head 45 provided with a rearwardly extending cylindrical sleeve 46 forming a rearwardly opening cavity containing a wire assembly 48, as described above. The head 45 includes a barbed needle 49, as described above. The wire assembly 48 may include or not include the bonding agent of the prior embodiment. The wire assembly 48 is in the form of a compact single-layer, multi-layer or hybrid self-supported wire coil enclosed in the sleeve 46. One end of the projectile unit's wire assembly is connected to the inside end face of head 45, for instance, with a pasted insert or by passing the wire through an open-ended hole in the closed end and tying a knot at the outlet. The other end of the wire assembly 48 is attached to a ring or washer 50 for securing the wire to the projectile unit 41. A percussive cap 52 is pressed into a counterbore at the rear end of the cartridge housing. The percussive cap 52 is at the same time a propelling pyrotechnic charge that is triggered by the fusehead from the electroshock weapon's low-voltage power supply. The projectile unit 41 is retained in the housing 43 by an adhesive film 54, which prevents projectile unit 41 from moving or falling out should the cartridge fall to the ground or be knocked about during transport.

When the cap 52 is triggered, the combustion gases from the pyrotechnic charge in chamber accelerate the projectile unit 41 rupturing the film 54 on flight toward the target. At the same time, the wire of the wire assembly 48, held back at one end within cartridge housing by ring 50, is pulled out of sleeve 46 during flight. The short duration of the hot combustion gases' effect on wire allows for the latter to be made either uninsulated or with insulation. Upon reaching the target, the projectile unit 41, along with the remainder of unextended wire, attaches to the target with the needle 49. The electroshock weapon's high-voltage potential is delivered to the target by means of advancing it to the cartridge housing and from there through the electric wire assembly to the needle 49.

Figure 4:
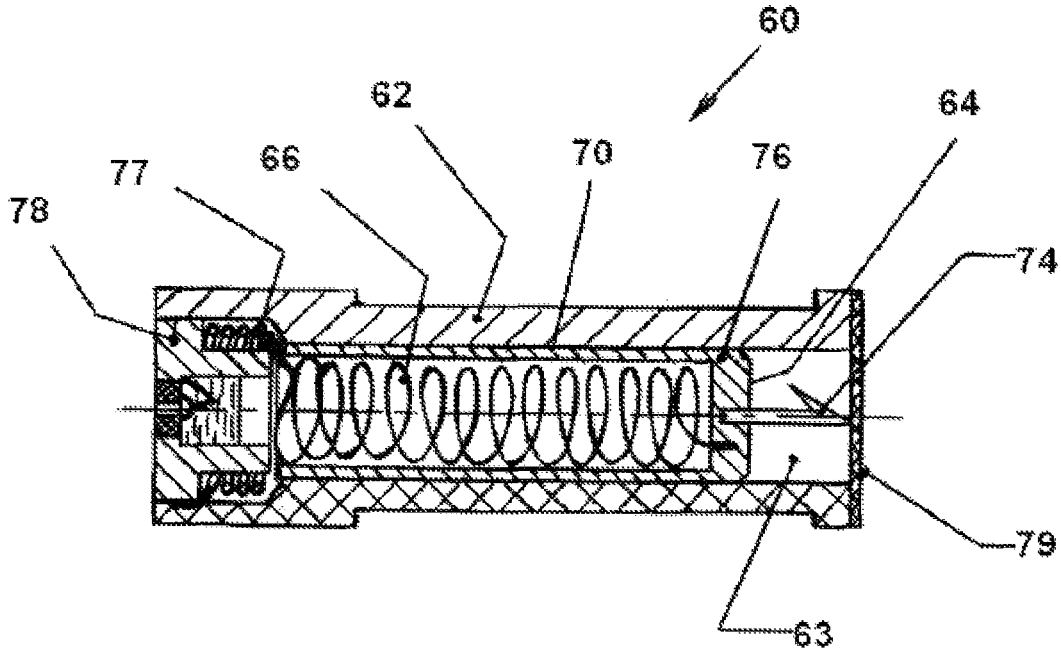
FIG. 4 is a cross sectional view of a cartridge in accordance with another embodiment of the invention.

Referring to FIG. 4 showing another embodiment, the cartridge 60 has a housing 62 having a chamber 63. The housing 62 is made of metal or plastic. Inside the chamber 63, which is also the barrel, is situated a projectile unit 64. The projectile unit 64 comprises an electric wire assembly 68 in the form of a compact single-layer, multi-layer or hybrid self-supported wire coil enclosed in a cylindrical sleeve 70 of a head assembly or shell 72. The head assembly 72 in this embodiment made of metal. A barbed needle 74 is secured to the head 76 of the head assembly adjacent the front end. One end of wire for the wire assembly 68 is attached to the inside end of head 72. The other end of wire is attached to a non-conductive line 77. The line 77 is 5 to 20 cm. in length and made of heat-resistant or fire-resistant material, for instance the polyaramide fiber "Nomex" or a natural fiber permeated with a fire-retardant compound. The line 77 is laid around the housing of a percussive cap 78 to protect it from the effects of the flame from the pyrotechnic charge of the cap 78. The end of line 77 is secured in the end of housing 62, for instance by grasping it in the housing while pressing in the cap 78 into place. An adhesive film 79 retains the projectile unit 64 within the chamber 63. When the cap 78 is triggered, the combustion gases from the pyrotechnic charge in chamber 63 accelerate projectile unit 64, rupturing the film 79 in flight toward the target. At the same time, the line 77, laid around the housing of cap 78 and held back at one end within cartridge housing, leaves the housing. The brief duration of the pyrotechnic charge's hot combustion gases' effect on line 77 prevents it from being burned out and destroyed. When the line 74 is completely drawn out, its outer end, attached to the end wire of the wire assembly, pulls wire of the wire assembly out of projectile sleeve 70 as the latter flies toward the target. Upon reaching the target, the projectile unit, along with the remainder of unextended wire, attaches to the target with needle 74. The electroshock weapon's high-voltage potential is delivered to the target by means of electric discharge to the wire assembly through a barrel guide contact which is built in at the end of the electroshock weapon's housing.

Figure 5:
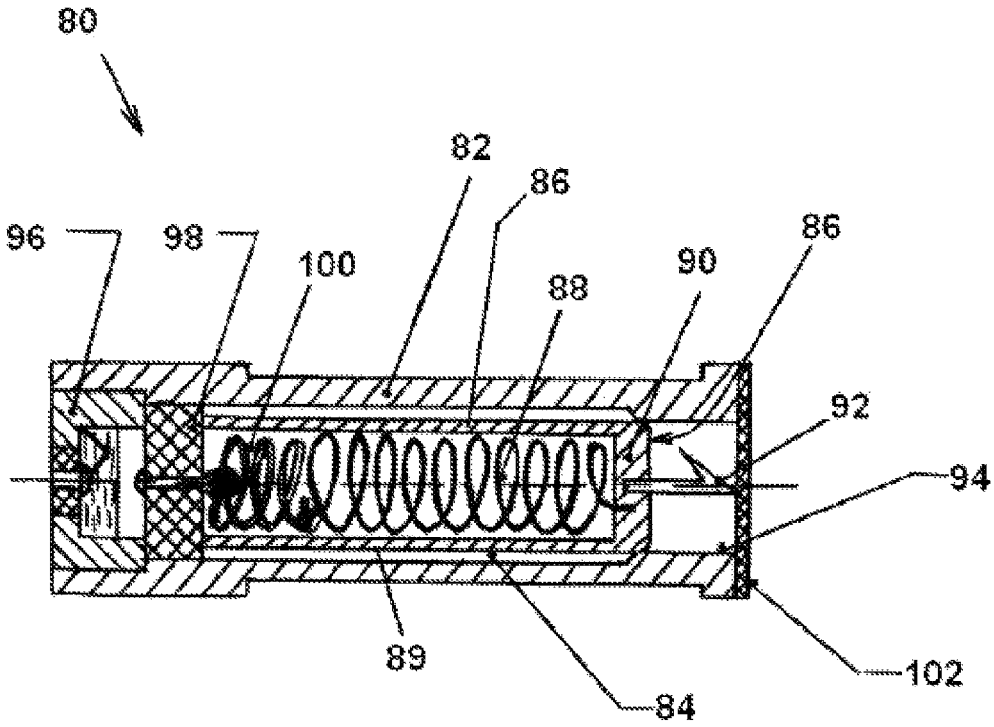
FIG. 5 is a cross sectional view of a cartridge in accordance with another embodiment of the invention.

Referring to FIG. 5 illustrating another embodiment, the cartridge 80 includes a housing 82 having a chamber 84. The housing 82 is made of metal or plastic. The chamber 84, which is also the barrel, carries a projectile unit 86 including an electric wire assembly 88 in the form of a compact single-layer, multi-layer or hybrid self-supported wire coil enclosed in a cylindrical sleeve 89 of propulsion shell or head assembly 90. A barbed needle 92 is secured to the front end of the shell 90. The front section 94 of the chamber 84 has a reduced diameter. A percussive cap 96 is situated in a counterbore at the rear end of housing 82. The cap 96 is triggered by a fusehead and is separated by an obturator wad 98 from the shell 90 and the wire assembly 88. One end of the wire assembly is secured to the obturator wad 98 by a non-conductive line 100, for instance by a loop secured in the body of the obturator. The other end of the wire is attached to the interior end wall of shell 90. The projectile unit 86 is secured within the chamber by a split adhesive film 102, which is made metal-coated or non-conductive.

Figure 6:
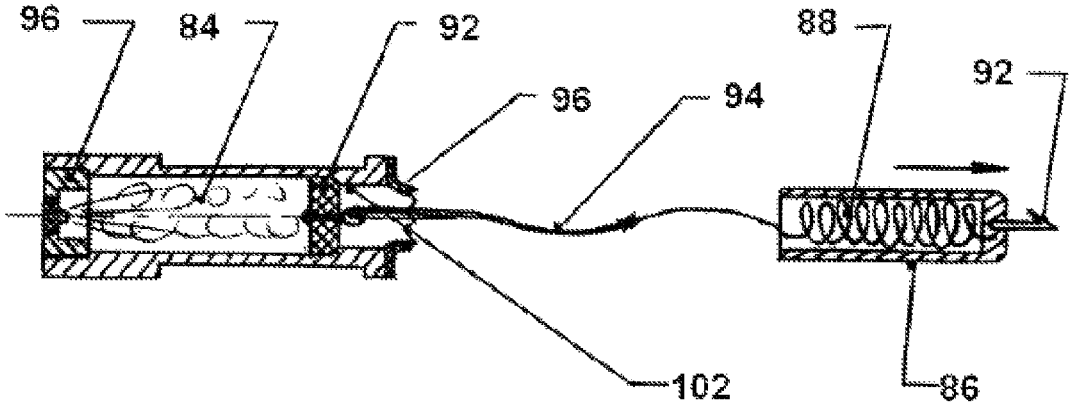
FIG. 6 is a cross sectional view of the cartridge of FIG. 5 at the moment of firing.

FIG. 6 illustrates the cartridge 80, at the moment of firing. When the cap 96 is triggered, the combustion gases from the pyrotechnic charge in chamber 84, acting on obturator wad 98, accelerate the shell 90 and wire assembly 88 thereby rupturing the film 102. After the obturator wad 98 reaches the reduced diameter muzzle narrowing 94 of the chamber 84, it slows in the muzzle narrowing, while shell and wire assembly continue to move by inertia and, exiting from cartridge chamber, continue to fly toward the target. At the same time, the line 100, held back at one end in obturator wad 98 which has stopped in the cartridge housing, leaves the housing. When line 100 is fully extended, its end draws the bulk of the wire assembly out of the shell as it flies toward the target. Upon reaching the target, the shell, along with the remainder of unextended wire, grips the target with the needle. The electroshock weapon's high-voltage potential is delivered to the target by means of advancing it by electric discharge to the end of wire, which is attached to the non-conductive line through the barrel guide contact which is built in at the end of the electroshock weapon's housing.

Figure 7:
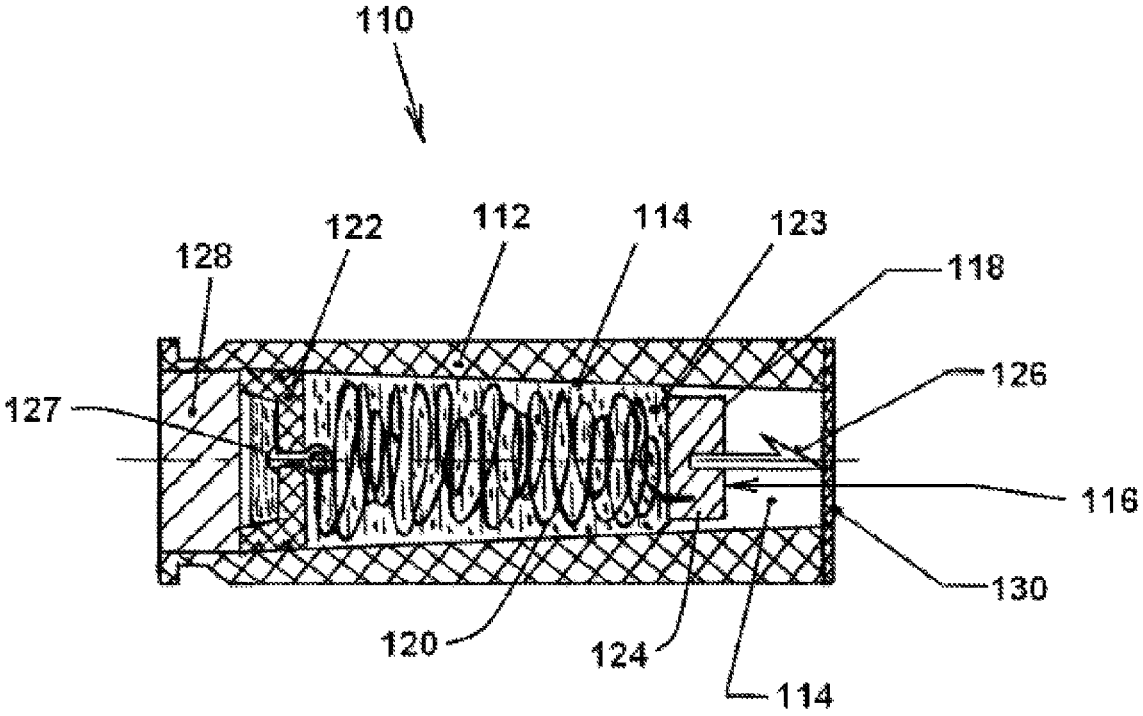
FIG. 7 is a cross sectional view of a cartridge in accordance with another embodiment of the invention.

Referring to FIG. 7 illustrating another embodiment, the cartridge 110 includes a plastic housing 112 with a chamber 114 carrying a projectile unit 116. The projectile unit 116 includes a shell or head assembly 118 carrying an electric wire assembly 120, which is in the form of a compact single-layer, multi-layer or hybrid self-supported wire coil. The interior surface of chamber 114 is tapered, with the front diameter less than the rear. An electric-spark ignition cap 122, made of non-conductive elastic material, is situated within chamber 114 and is at the same time an obturator wad. The wire assembly 120 of the projectile unit is cemented with ductile bonding agent 123. One end of the wire assembly 120 is connected to the head assembly 118, which is made primarily of heavy metal. The head assembly includes a cylindrical head 124 includes a barbed needle 126 for attaching to the target. The other end of the wire assembly of is connected to cap 122, with the end of the wire having an electric contact 127 through the end of the cap to the pyrotechnic charge that is situated in the cap chamber. The end of chamber 112 has a metal plug 128 mounted onto a thread or pressed into a counterbore at the rear of the housing 122. The projectile unit 116 is secured in the chamber 114 by split adhesive film 130, which is metal or metal-coated. When cap 122 is triggered by applying the electroshock weapon's high-voltage potential to plug 128 and needle 126 through adhesive film 130, the electric spark within cap 122 ignites the pyrotechnic charge. Accelerated by cap 122, the projectile unit 116 moves within chamber and ruptures the film 130. The cap 126 gradually collapses within the tapered chamber and slows and stops in the chamber's narrow end. The projectile unit 116 continues to move by inertia, exiting from the cartridge chamber. With the movement of projectile unit, the end of the wire assembly 120, held back by cap 122 which has been slowed in chamber, remains in cartridge chamber, while the bulk of the wire assembly, cemented by bonding agent 123, completes its flight along with head toward the target. During the flight of projectile unit, the wire from the electric wire assembly is drawn out of the compact body, breaking bonding agent. Upon hitting the target, the head, along with the remainder of the unit's compact body, attaches to the target with barbed needle 126. The electroshock weapon's high-voltage potential is delivered to the target by means of an electrical discharge through the air gap between the metal-coated film 130 and the electric wire exiting from the cartridge mouth. The high-voltage electrical circuit in chamber is cut, as in the description for FIG. 8.

Figure 8:
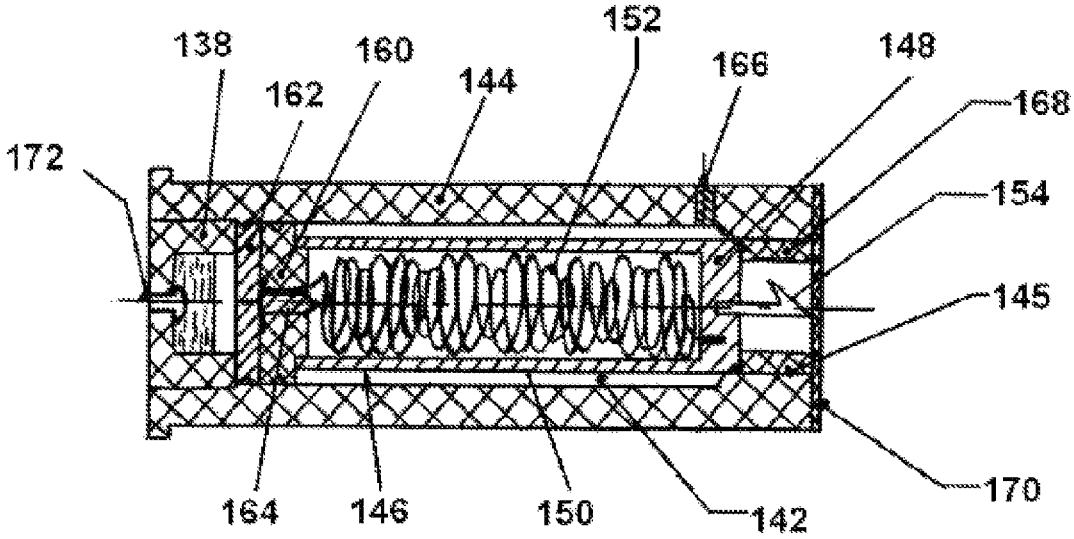
FIG. 8 a cross sectional view of a cartridge in accordance with another embodiment of the invention.

Referring to FIG. 8 showing another embodiment, the cartridge 140 is carried in the chamber 142 of the plastic housing 144. The chamber has a reduced diameter front end section 145. A projectile unit 146 is carried in the chamber 142. The projectile unit 146 includes a head assembly or shell 148 having a sleeve 150 carrying a wire assembly 152. The wire assembly comprises a wire in the form of a compact single-layer, multi-layer or hybrid self-supported wire. A barbed needle 154 is secured to the front end of the shell. An electric-spark ignition cap 158, made of non-conductive material, is situated in the end of housing 144 and is divided from shell 148 and the wire assembly 152 by an obturator wad that consists of an elastic obturating part 160 and a metal thrust-bearing part 162. The inner end of the wire of the wire assembly passes through the obturating part 160 and is joined to the metal thrust-bearing part 162 of the obturator wad, for instance by winding it onto a point 164 of part 162 and securing with obturating part 160 which is fitted over the point. At the place where chamber begins the transition to the reduced diameter of its front section, there is a conducting lead terminal 166 from chamber to the external surface of housing. A split sleeve 168 and adhesive film 170 retain the projectile unit in the chamber. When cap 158 is triggered by applying the electroshock weapon's high-voltage potential to the electrode 172 of cap 158 and to the conducting lead terminal 166, the electric spark inside cap between electrode 172 and the metal thrust-bearing part 162 of the obturator wad ignites the pyrotechnic charge of the cap.

The projectile unit 146, along with the wire assembly 152, accelerated by the pyrotechnic charge from the cap, ruptures the film 170 and the split sleeve 168 is ejected as described above. After the obturator wad 162 reaches the reduced diameter front section, it slows and stops, while shell and wire assembly continue to move by inertia and, exiting from cartridge chamber, complete their flight toward the target. The high-voltage electric circuit (electric spark), which is necessary to ignite the pyrotechnic charge but inadmissible after firing, is severed by increasing the distance between the conducting lead terminal or electrode 172 of cap and the obturator wad's metal thrust-bearing part 162. In order to prevent a high-voltage disruption of the electrical current caused by the settling of conductive products of combustion from the pyrotechnic charge in the chamber, a pyrotechnic charge is used in cap that produces non-conductive products of combustion. As the shell and wire assembly move toward the target, the end of the wire assembly, held in the obturator wad, remains in housing, while the bulk of wire is pulled out of the shell as it flies toward the target. Upon reaching the target, the shell, along with the remainder of unextended wire, attaches to the target with the needle 154. The electroshock weapon's high-voltage potential is delivered to the target through the electrode 166, the metal part 162 of the obturator wad, and to the electric wire that exits from the cartridge mouth and attaches to the target after firing.

Having thus described a presently preferred embodiment of the present invention, it will now be appreciated that the objects of the invention have been fully achieved, and it will be understood by those skilled in the art that many changes in construction and widely differing embodiments and applications of the invention will suggest themselves without departing from the spirit and scope of the present invention. The disclosures and description herein are intended to be illustrative and are not in any sense limiting of the invention, which is defined solely in accordance with the following claims.

What is claimed is:

1. A cartridge for delivering a projectile unit in an electroshock weapon wherein a pair of independent projectile units contact and establish an electrical connection of differing polarity with a target, comprising: a housing adapted for operative connection with one polarity of the electroshock weapon, said housing having no more than a single chamber forming an opening therethrough wherein said chamber has a cylindrical front section and a coaxial cylindrical rear section; one of said projectile units located in said chamber, said projectile unit having a head member slidably supported in said front section and a rearwardly extending cylindrical sleeve in said rear section; and an orderly packed wire assembly of electric wire in said rear section and having one end connected with said head member and another end electrically connected to said housing wherein said wire is arranged in the form of a compact self-supported coil, said head member having contact means for establishing an electrical connection with a target; and a pyrotechnical energy source carried on said housing at a rear end of said chamber adapted to be ignited by the electroshock weapon for forwardly propelling said projectile unit whereby at said target electrical current of said one polarity is conducted through said wire from the weapon to said contact means for establishing an electrical connection with said target.

2. The cartridge as recited in claim 1 wherein said housing is made of metal or plastic.

3. The cartridge as recited in claim 1 wherein said contact means on said head of said projectile unit has a target-gripping device in the form of a conductive head having at least one barbed needle.

4. The cartridge as recited in claim 1 wherein said wire or said wire assembly is cemented by a bonding agent.

5. The cartridge as recited in claim 4 wherein bonding agent is ductile.

6. The cartridge as recited in claim 1 wherein said projectile unit includes a rear cylindrical sleeve carrying said wire assembly.

7. The cartridge as recited in claim 1 wherein said pyrotechnic charge is triggered by an electrical spark, a fusehead, or by percussive means.

8. The cartridge as recited in claim 1 wherein said projectile unit in retained in said chamber by a cover member over said open end.

9. The cartridge as recited in claim 8 wherein said cover member is an adhesive film.

10. The cartridge as recited in claim 1 wherein said wire is made insulated or non-insulated.

* * * * *